US011009329B2

(12) United States Patent
Wurzel et al.

(10) Patent No.: US 11,009,329 B2
(45) Date of Patent: May 18, 2021

(54) PROJECTILE FUZE ASSEMBLY AND METHODS OF ASSEMBLING AND USE

(71) Applicant: BAE Systems Rokar International Ltd., Jerusalem (IL)

(72) Inventors: Gil Wurzel, Maas (IL); David Elkaim, Jerusalem (IL); Michael Koltun, Yokne'am (IL)

(73) Assignee: BAE Systems Rokar International Ltd., Jerusalem (IL)

( * ) Notice: Subject to any disclaimer, the term of this patent is extended or adjusted under 35 U.S.C. 154(b) by 0 days.

(21) Appl. No.: 16/504,284

(22) Filed: Jul. 7, 2019

(65) Prior Publication Data

US 2020/0200517 A1 Jun. 25, 2020

(30) Foreign Application Priority Data

Dec. 20, 2018 (IL) ..... 263880

(51) Int. Cl.

| | |
|---|---|
| ***F42B 10/64*** | (2006.01) |
| ***F42C 15/42*** | (2006.01) |
| ***F42C 13/00*** | (2006.01) |
| ***F42C 19/02*** | (2006.01) |

(52) U.S. Cl.

CPC ..... *F42C 15/42* (2013.01); *F42B 10/64* (2013.01); *F42C 13/00* (2013.01); *F42C 19/02* (2013.01)

(58) Field of Classification Search

CPC ..... F42B 10/64; F42B 10/60
USPC ..... 244/3.29, 3.24, 3.28, 3.23
See application file for complete search history.

(56) References Cited

U.S. PATENT DOCUMENTS

| | | | | |
|---|---|---|---|---|
| 4,964,593 | A * | 10/1990 | Kranz | F42B 10/64 102/208 |
| 5,115,742 | A | 5/1992 | Frazer | |
| 7,718,937 | B1 * | 5/2010 | Dunn | F42B 10/64 244/3.11 |
| 9,587,923 | B2 * | 3/2017 | Wurzel | F42B 10/64 |
| 2012/0175458 | A1 * | 7/2012 | Geswender | F42B 10/06 244/3.24 |

FOREIGN PATENT DOCUMENTS

| | | |
|---|---|---|
| FR | 2881821 | 8/2006 |
| WO | WO 2007/030687 | 3/2007 |
| WO | WO 2008/108869 | 9/2008 |

OTHER PUBLICATIONS

European Search Report of Application No. EP19185043.7 dated Dec. 2, 2019.

* cited by examiner

*Primary Examiner* — Reginald S Tillman, Jr.
(74) *Attorney, Agent, or Firm* — Pearl Cohen Zedek Latzer Baratz LLP

(57) ABSTRACT

A guiding kit for guiding a projectile to a target comprises a front part and a rear part. The front part and the rear part are rotatably connected to each other to enable relative rotation about a common central longitudinal axis of rotation. The front part comprises a front transceiver (T/X) unit that is disposed next to the rear end of the front part and coinciding with the longitudinal central axis of rotation and adapted to transmit signals towards the rear part. A rear transceiver unit is disposed against the front transceiver unit and adapted to communicate with front transceiver unit when the front part and the rear part are rotating with respect to each other.

7 Claims, 4 Drawing Sheets

PROJECTILE FUZE ASSEMBLY AND METHODS OF ASSEMBLING AND USE

CROSS REFERENCE TO RELATED APPLICATIONS

This application claims the benefit of Israel Patent Application No. 263880, filed on Dec. 20, 2018, which is incorporated herein by reference in its entirety.

BACKGROUND OF THE INVENTION

Known guiding kits or warheads of projectiles comprise mechanical, electronic and projectile ignition elements assembled and packed together, and, therefore, handling of the guiding kit/warhead must comply with the handling measures compatible with explosives. As a result, handling of such guiding kits is complicated, cumbersome and imposes strict measures. FIG. 1A depicts an example projectile 100 comprised of projectile body 102A and projectile warhead (e.g., comprising guiding kit and fuze unit) 102B.

Warhead 102B may comprise front unit 106 and rear unit 104, each of which is adapted to rotate with respect to each other. A warhead adapted to provide guidance to a target to the projectile typically comprises at least a set of fins adapted to cause front unit 106 to spin about a longitudinal axis due to aerodynamic forces in a controlled spinning speed, which is typically different from the spinning speeds of projectile body 102A and rear unit 104. The spinning speeds of front unit 106 and rear unit 104 may differ in at least one of direction and angular speed.

Engineering constrains typically lead to design of guiding warheads where the mechanics and electronics, which are associated with the guiding portion of the warhead's tasks, are assembled together with the fuze element, which is associated with the projectile ignition task, so that, during storage, conveying and pre-firing stages, the fuze is an inseparable from the mechanics and electronics units.

Typical design constrains applicable to the design of a guiding warhead for a projectile stem from the need to enable mechanical, electrical and explosion connections between the various functional and physical units of the guiding warhead, that should all be packed in physical spaces that spin and wherein at least some of the functionalities must be placed in the front part of the warhead, which, during operation, spins with respect to the rear part of the warhead, while certain functional communication must be maintained between the front and the rear parts, in order to enable, at the right conditions, ignition of the projectile charge, which is located behind the rear part, with respect to the direction of firing.

Common designs of guiding warheads address the difficulty discussed above by enclosing and containing the electronic, mechanical and ignition fuze functionalities in a common container, namely the front part, and enable transferring the explosion signal to the main projectile charge by allowing explosion path from the front part, that spins with respect to the rear part, to the main charge in the rear part.

FIG. 1B depicts a typical design of guiding warhead 150, which addresses that problem in a way discussed above, as known in the art. Guiding warhead 150 comprises front unit 150A and rear unit 150B. Rear unit 150B is adapted to be firmly connected to the projectile body (not shown) and to spin with it. Front unit 150A may be connected to rear unit 150B so that it may spin free of the spin of rear unit 150B about common longitudinal axis 151. Rear unit 150B may be rotatably connected to front unit 150A via a set of bearings

170. Warhead 150A typically comprises mechanical assembly 156, which is adapted to control the deployment and/or the angle of attack of fins 160, for example by electromechanical motor-gear unit (not shown). Warhead 150A further comprises electronic unit 158 with electrical power source (for example, a charged battery or a generator operable by the relative spin of front and rear portions), safe and arm safety unit 154, adapted to prevent charge ignition before certain safety conditions are met and booster charge 153, which is adapted to receive explosion signal from the warhead control system (not shown) and to ignite the main charge as result of its explosion. All of these elements are contained in envelope 190 of front part 150A. Envelope 190 is rotatably connected to case 180 of rear part 150B by means of bearing assembly 170. The main charge 152 of the projectile is contained in rear part envelope 170 or is disposed close to it. This design provides that front part 150A comprises at least one explosive unit as an integral part thereof, which requires explosives expert for constructing/dismantling and/or for routine handling such as storing, conveying to the field and applying routine maintenance to the warhead.

There is a need for a guiding warhead that does not include, when not installed on a projectile, any explosive unit, and that allows easy installation of the fuze element(s) onto the guiding warhead as close before an intended use. There is further need for a complete electrical separation between the guiding part and the explosive part of the guiding warhead, in order to ensure absolute zero electrical sources being part of the explosive part of the guiding warhead, prior to actual firing of the projectile. It is, therefore, required that the explosive part has an independent electrical source, that is not accumulated before the shooting. It is further required that the detonation chain of the new guiding kit will comply with the installation terms and safety requirements as the existing detonation chain including optional including of safe-and-arm that includes overhead safety measures. Further, it is required that the explosive part will have improved heat separation from the guiding kit, to provide improved protection against undesired explosion.

SUMMARY OF THE INVENTION

A guiding kit for guiding a projectile to a target is presented. The guiding kit comprising a front part and a rear part. The front part and the rear part are rotatably connected to each other to enable relative rotation about a common central longitudinal axis of rotation. The front part comprises a transceiver (T/X) unit disposed next to the rear end of the front part, coinciding with the longitudinal central axis of rotation and adapted to transmit signals towards the rear part. A first part of an electric generator is disposed next to the front end of the rear part, coinciding with the longitudinal central axis of rotation at the rear end of the front part, adapted to be in operational communication with a second part of the electric generator, which is disposed in the rear part. The rear part comprises an assembly container extending from the front end of the rear part backwardly, the assembly container is adapted to receive assembly operative with the projectile, by placing the assembly inside the container with a signal receiver connectable to a receiver port and a receiver port disposed at the front end of the assembly container, against the transceiver (T/X) unit, facing the transceiver (T/X) unit and adapted to receive signals transmitted by the transceiver (T/X) unit.

In some embodiments, the front part further comprises a first part of an electric generator 242 disposed close to the rear end and distal from the common longitudinal axis, and the rear part further comprises a second part of an electric generator disposed close to the front end and distal from the common longitudinal axis, adapted to cooperate with the first part of the electric generator to produce electricity when the front part and the rear part rotate with respect to each other. In this embodiment the term 'close', as used above means no more 1.5 mm, such that the total gap between the two parts of the generator is no more than 3 mm. further, in this embodiment the term 'distal' as used above refers to distance that is no less than half of the radius of the projectile.

In some embodiments, the assembly container is adapted to accommodate an ignition and detonation control package. The package may comprise an electronic unit, adapted to receive signals from the main control unit in the front part, and to control a safe-and-arm and electric detonator with safety mechanism and a detonation process, a safe-and-arm safety unit, adapted to carry out safety measures under control of the electronic unit, and a detonation booster unit, controllable by the safe-and-arm unit.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
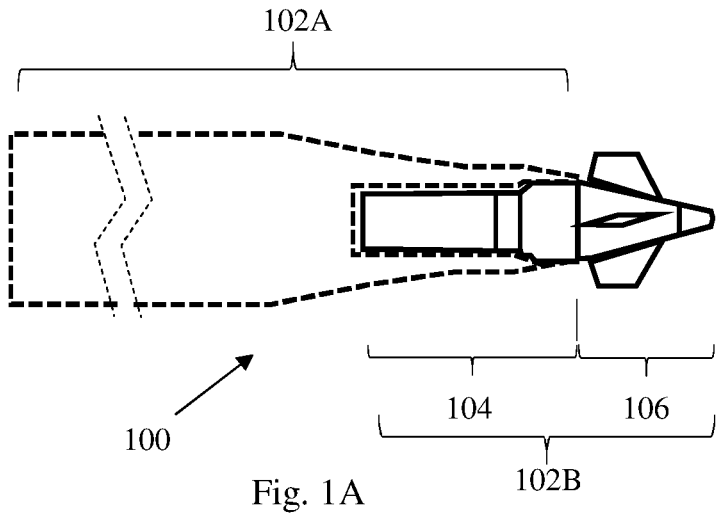
Fig. 1A PRIOR ART
FIG. 1A depicts an example of a projectile as known in the art.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The term "projectile" is used hereinbelow to describe all kinds of munition that may be shot, fired, launched and like, from a mortar, cannon, rocket launcher and the like. The term projectile is further used hereinbelow to describe all kinds of munitions that are made to spin around their longitudinal, forward pointing axes while in flight.

Figure 1B:
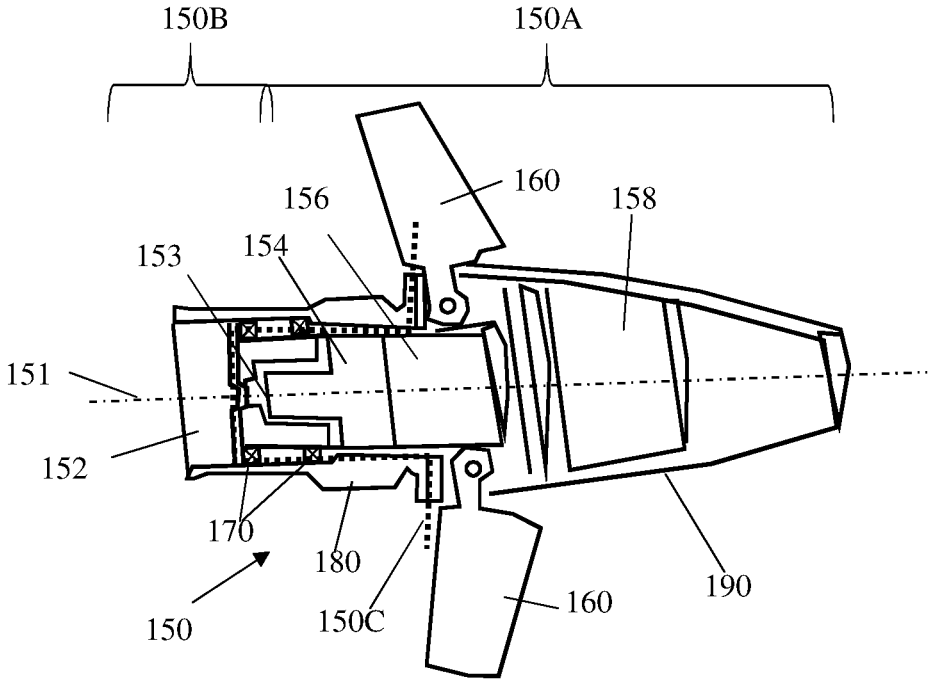
Fig. 1B PRIOR ART
FIG. 1B depicts a typical design of a guiding warhead as known in the art.

Analysis of the guiding warhead design difficulties depicted above teaches that the difficulties concentrate around the "border line" between the two mutually-spinning parts, the front part and the rear part of the warhead, as depicted in warhead 150 of FIG. 1B by black dotted line 150C. The mutual spinning of the front and rear parts poses heavy difficulties on any kind of signal transferring, power transferring or control transferring through the border line.

Figure 2A:
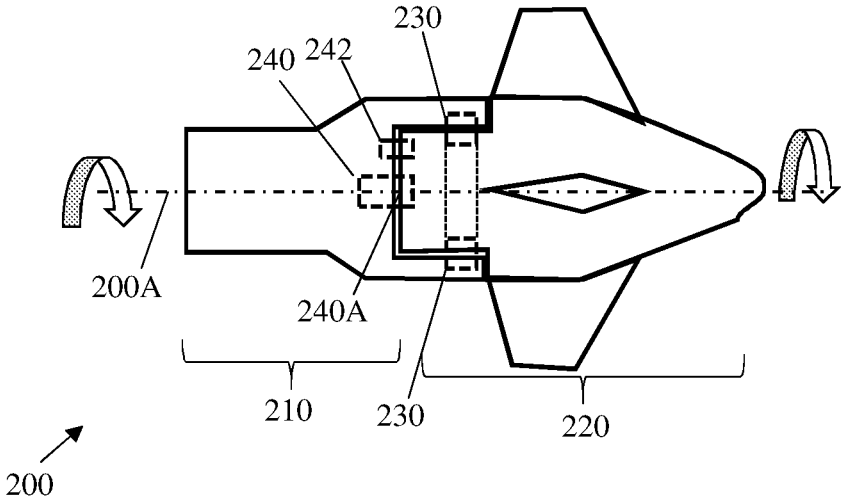
FIG. 2A is a schematic illustration of a two-part guiding warhead according to some embodiments of the present invention.
Figure 2B:
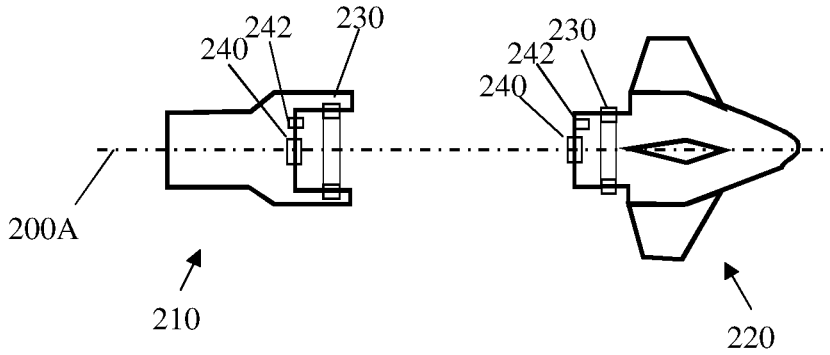
FIG. 2B depicts the warhead of FIG. 2A in dismantled position.

Reference is made now to FIG. 2A which is a schematic illustration of a two-part guiding warhead 200 and to FIG. 2B which depicts warhead 200 of FIG. 2A in dismantled position. Front part 220 and rear part 210 of guiding warhead 200 may be adapted to spin with respect to each other about a common spinning axis 200A, for example in counter spinning directions as indicated by the arrows. The mechanical border line between rear part 210 and front part 220 may be characterized by at least two substantially different types of zones. First border line zone 230 is located around (i.e., on both sides of) the border line and substantially remotely from the spinning axis line 200A, and as such experiences relatively high tangential rotation speeds. A second border line zone 240 is located around (i.e., on both sides of) the border line and substantially close to the spinning common axis line 200A and preferably coinciding with the spinning common axis line 200A. As such, second zone 240 experiences very low (and even approaching zero) tangential rotation speeds.

According to some embodiments of the present invention, a projectile guiding kit is disclosed which is adapted to be stored, undergo maintenance, conveyed and prepared for installation prior to shooting without being attached to any explosive, and further it is adapted to enable attaching the projectile charge ignition assembly in an easy and safe manner. A projectile guiding kit is provided which comprises a front part and a rear part rotatably connected to each other, to allow spinning of each one of them about their common longitudinal axis free of each other, as is known in the art. The front part may comprise one or more aerodynamic fins, adapted to provide spinning force, to control the spinning speed and/or to control the angle of attack of the fin(s) so as to provide trajectory corrections, as is known in the art.

In order to enable the above, the front part may comprise controller, navigation unit, electromechanical unit(s) and the like, as is known in the art. The front part may additionally comprise a power source, such as a battery or an electric generator. Such electric generator may be powered by the relative spin of the front part with respect to the rear part. The front part may mechanically be connected to the rear part via a set of bearings, as is known in the art. Further, in the region where the rear end of the front part overlaps the front end of the rear part, one or more mechanical-electrical units may be disposed, adapted to take advantage of the relative spinning of the two parts. One such mechanical-electrical unit may be a spinning speed control break. Another such mechanical-electrical unit may be an electric generator. The electric generator may be adapted to provide electrical power when the front and the rear parts are spinning with respect to each-other. The electrical power may be provided to the electrical consumers disposed in the front part. It will be apparent that no electrical connection is enabled between the electrical units of the front part, such as units 322, 344 and 340 of FIG. 3 below, and any unit accommodated in the rear part of the guiding warhead, such as part 310 of FIG. 3, below.

The electrical break may be any known electrical break, adapted to have its breaking force be controlled by the controller.

Figure 3:
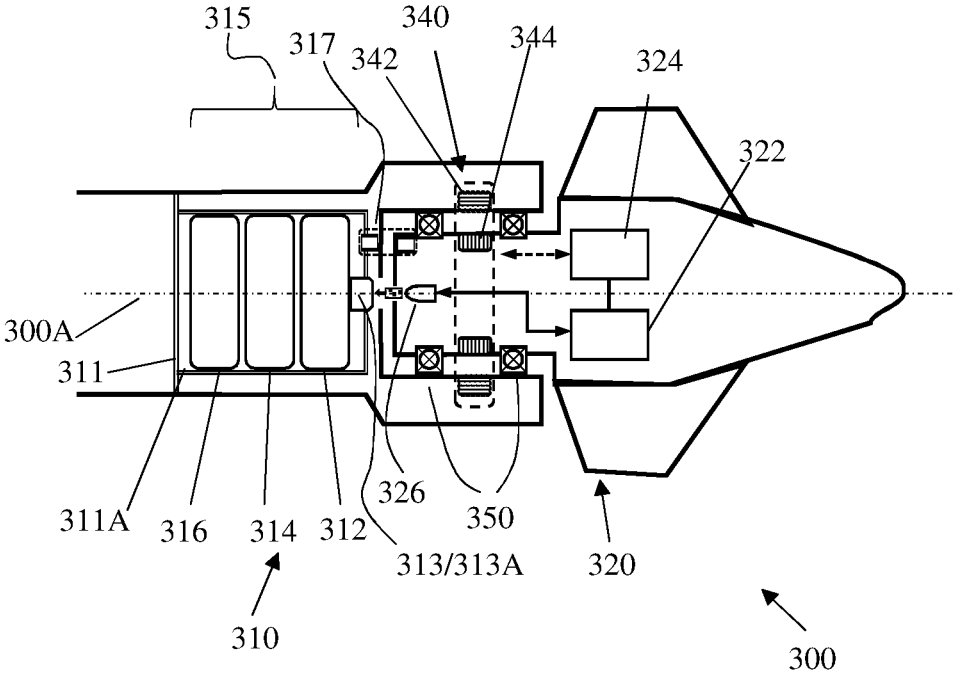
FIG. 3 is a schematic illustration of a guiding kit built and operable according to some embodiments of the present invention.

Reference is made now to FIG. 3, which is a schematic illustration of guiding kit 300, built and operable according to some embodiments of the present invention. Guiding kit 300 comprises front part 320 and rear part 310, rotatably connected to each other via a set of bearings 350 adapted to enable relative spinning of the front a rear parts 310, 320 about a longitudinal common axis 300A. Front part 320 may comprise an external body on which may be disposed, fixedly or disposably, one or more aerodynamic fins. Inside the body of front part 320 several functionalities may be disposed, embodied in one or more units, comprising controller, navigation, unit, communication unit, control unit, and the like, as is known in the art for guidable projectiles. Main control unit 322 in FIG. 3 may be adapted to function and operate the above-mentioned functionalities. Main unit 322 may be powered, at least prior to the shooting of the projectile, by any known electrical storage device, such as battery, rechargeable battery, capacitor and the like. Main unit 322 may additionally be powered by electrical generator that may be part of unit 340.

Front part 320 may further comprise transceiver (T/X) unit 326 disposed at the rear end of front part 320, facing rearwardly and disposed so to enable transmission, and/or reception of communication sent to, or received from front end of rear part 310. Communication between T/X unit 326 and a receiver disposed in receiver port 313 (discussed in details below) may be one or more from a list consisting of infrared (I/R) communication, Bluetooth protocol communication or any other wireless communication adapted to transmit/receive the type of data/signals exchanged in that channel, as discussed below. In some other embodiments, the communication between the front part and the rear part may be embodied using a spring-loaded metal pin (not shown) disposed in one of the parts, e.g., in the front part, and adapted to be centralized with the axis of rotation so that when it rotates, it maintains its centralized location. Against the pin and in a distance ensuring good contact with the pin when the front and the rear parts are connected, a flat metallic element (or other hard material with good electrical conductivity) may be disposed (not shown). The signals from the front part may be transferred to the rear part through the electrical contact between the pint and the flat metallic element.

Rear part 310 may be formed as an assembly container 311 with containing space 311A disposed extending from the front end of rear part 310 backwardly, with a containing space 311A designed to accommodate the required elements, as discussed hereinbelow. Rear part 310 may have an independent electrical power source, for example a dedicated independent generator/alternator 317, adapted to provide electric power only when front part 320 and rea part 310 spin with respect to each other. Generator/alternator 317 may comprise, for example, a magnet disposed in the rear end of front part 320 and a respective coil disposed against the magnet at the front end of rear part 310 Rear part 310 may further have a receiver port 313, disposed in the center of the front end of rear part 310, facing, with its receiving side, the rear end of front part 320, via rear part container orifice 313A. Receiver port 313 may preferably be disposed on longitudinal central axis 300A. Receiver port 313 may be formed and made of, or may be enclosed in, materials conforming with the type of communication used between T/X unit 326. For example, when IR communication is used, receiver port 313 may be formed as an orifice preferably covered by transparent cover that allows for IR signals to pass through. When radio communication is used, e.g., Bluetooth, receiver port 313 may be formed as an orifice transparent to radio signals, covered by a material transparent to radio signals, but not necessarily to visible or IR light.

Disposal of receiver port 313 in the center of rotation of rear part 310, coinciding with the longitudinal axis 300A of guiding kit is beneficial, and even essential, to enable uninterrupted communication channel between the front part 320 and the rear part 310, regardless of the mutual rotation of these parts. This is made possible by locating T/X unit 326 of front part 320 facing an orifice made in the rear end of front part 320 and allowing passing of signals from T/X unit 326 towards receiver port 313 in rear part 310, regardless of rotation of rear part 310 and front part 320 with respect to each other.

Power generator/alternator 317 is powered by the spin of its magnet with respect to its coil. Accordingly, providing power to rear part 310, if necessary, is solved, according to some embodiments of the present invention, while keeping complete electrical isolation between the units in front part 320 and units in rear part 310.

When guiding kit 300 is intended for with active projectile, assembly container 311 may be occupied with charge safety and ignition/detonation control package 315, which may comprise electronic unit 312, safe-and-arm (S&A) and fuze detonator unit 314, and booster unit 316, each of which units may be built and operate as known in the art. Each of these units may be powered, if needed, by electrical power that may be provided by the electric generator/alternator 317.

In some embodiments, electronic unit 312 may be adapted to receive communication transmission from main unit 322, which may be transmitted by T/X unit 326 towards receiver port 313 and received and processed by electronic unit 312. Such communication may comprise information and/or control signals related to enabling/disabling/activating ignition or detonation of the charge.

Safe-and-Arm (S&A) unit 314 may be designed as is known in the art, to enforce requirements. The safety requirements may be represented by corresponding signals provided to the safe-and-arm unit 314, for example from the main control unit 322. In some embodiments, S&A unit 314 may receive information related to the completion of safety range from the firing device, for example based on the amount of rotations of electric generator unit 317, which may, in some embodiments, be directly related to the range of flight of the projectile after firing. Approval/enable of the detonation chain only after the projectile has gained safety range from the firing/launching site may be done by allowing a capacitor to be charged by generator 317, so that only after a safety number of rotations of front part 320 with respect to rear part 310 the capacitor will have sufficient charge to activate trigger-enable circuit and/or to have sufficient charge to ignite the detonation.

As is evident from the description of the embodiments above, assembling of charge safety and ignition control package 315 may be done only in very close to operational storage, requiring only ensuring of good placement of receiver port 313 against the container orifice and good electrical connection of ignition control package 315 with power port 317. As a result, handling of guiding kit made according to some embodiments of the present invention, such as guiding kit 300, does not require enforcement of explosives caution measures nor the handling by an explosives expert, until shortly before operational storage, when charge safety and ignition control package 315 need to be installed into guiding kit 300. This simplifies the entire chain of handling the guiding kit according to some embodiments of the invention. Proper design measures, as known in the art, ensure centralizing of the rear part 310 and/or ignition/detonation control package 315 with respect to front part 320. The decision when, along the process of handling the projectile, a detonation/explosive unit will be attached to the guiding kit remains in the discretion of the user.

Figure 4:
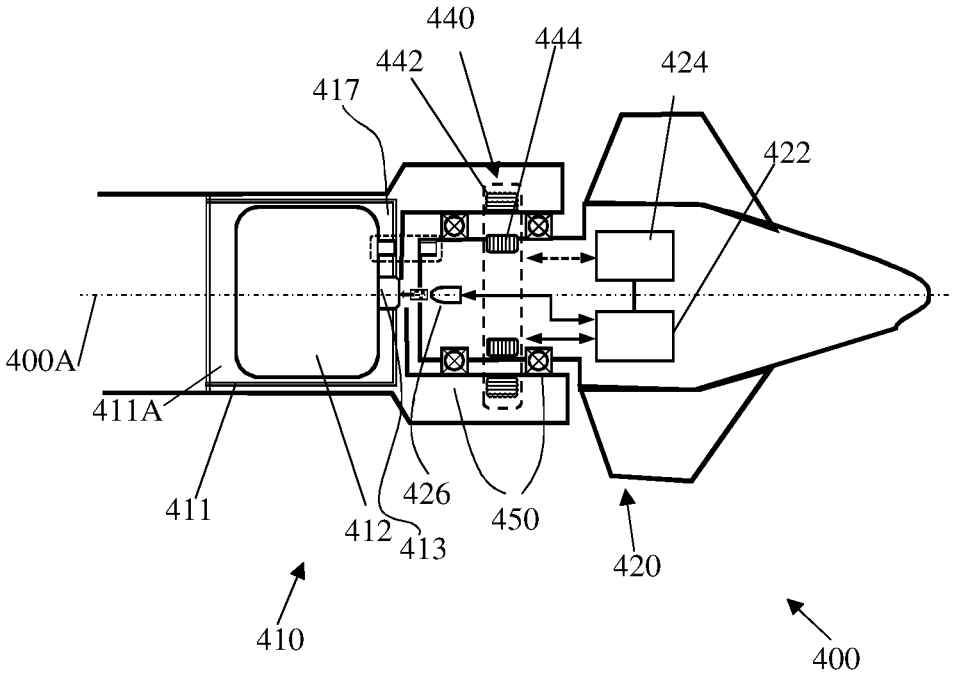
FIG. 4 is a schematic illustration of a general-purpose guiding kit assembly according to some embodiments of the present invention.

In some embodiments, a guiding kit may be used for purposes other than igniting or detonation a charge of the projectile. Reference is made now to FIG. 4, which is schematic illustration of a general-purpose guiding kit assembly 400, according to some embodiments of the present invention. Similar to guiding kit 300, guiding kit 400 comprises front part 420 and rear part 410, rotatably connected to each other via a set of bearings 450 adapted to enable relative spinning of the front a rear parts 410, 420 about a longitudinal common axis 400A. Front part 420 may comprise an external body on which may be disposed, fixedly or disposably, one or more aerodynamic fins. Inside the body of front part 420 several functionalities may be disposed, embodied in one or more units, comprising controller, navigation, unit, communication unit, charge ignition control unit (not shown), and the like, as is known in the art for guidable projectiles. Main unit 422 in FIG. 4 may be adapted to function and operate the above-mentioned functionalities. Main unit 322 may be powered, at least prior to the shooting of the projectile, by any known electrical storage device, such as battery, rechargeable battery, capacitor and the like.

Front part 420 may further comprise transceiver (T/X) unit 426 disposed at the rear end of front part 420, facing rearwardly and disposed so to enable transmission, and/or reception of communication sent to, or received from front end of rear part 410. Communication between T/X unit 426 and a receiver disposed in receiver port 413 (discussed in details below) may be one or more from a list consisting of infrared (I/R) communication, Bluetooth protocol communication or any other wireless communication adapted to transmit/receive the type of data/signals exchanged in that channel, as discussed below.

Rear part 410 may be formed as an assembly container 411, with containing space 411A disposed extending from the front end of rear part 410 backwardly, with a containing space designed to accommodate the required elements, as discussed hereinbelow. Rear part 410 may have an electrical power port 417, which may be powered by an electric generator in unit 440. Rear part 310 may further have a receiver port 413, disposed in the center of the front end of rear part 410, facing, with its receiving side, the rear end of front part 420, via rear part container orifice. Receiver port 413 may preferably be disposed on longitudinal central axis 400A. Receiver port 413 may be formed and made of, or may be enclosed in, materials conforming with the type of communication used between T/X unit 426. For example, when IR communication is used, receiver port 413 may be formed as an orifice preferably covered by transparent cover that allows for IR signals to pass through. When radio communication is used, e.g., Bluetooth, receiver port 413 may be formed as an orifice transparent to radio signals, covered by a material transparent to radio signals, but not necessarily to visible or IR light.

Disposal of receiver port 413 in the center of rotation of rear part 410, coinciding with the longitudinal axis 400A of guiding kit, is beneficial, and even essential, to enable uninterrupted communication channel between the front part 420 and the rear part 410, regardless of the mutual rotation of these parts. This is made possible by locating T/X unit 426 of front part 420 facing an orifice made in the rear end of front part 420 and allowing passing of signals from T/X unit 426 towards receiver port 413 in rear part 410, regardless of mutual rotation of rear part 410 and front part 420 with respect to each other.

Power port 417 is powered from the part of electric generator in unit 440 that rotates with the rear part 410. Accordingly, there is no design difficulty in providing power from the part electric generator in unit 440 that rotates with assembly container 411 and power port 417 may be located in container space 411A as may be required.

Guiding kit 400 may be used for accommodating, powering and providing with data signals various types of equipment. The example described herein relates to metric or telemetric data equipment, but it will be apparent that other types of equipment may be disposed in container 411. Unit 412 may be a metric capsule adapted to receive data representing, for example, various types of data handled by main unit 422 during its flight, such as momentary location of the projectile, calculated trajectory error, control signals that were provided to the guiding means, location of the projectile when S&A unarm signal was given, location with respect to the target when main charge fuze was enabled, etc. The collected data may be stored and/or processed and/or transmitted to a ground station for later analysis. According to some embodiments, unit 412 may be equipped with an independent power source, such as a battery.

It will be apparent to those skilled in the art that the decision whether to use guiding kit according to some embodiments of the invention in a warhead of a live projectile for controlling its activation, or to use it for testing purposes, such as used with a telemetric equipment, is a user's decision, according to his/her needs. Additionally, the decision whether to keep guiding kit according to embodiments of the invention installed with its detonation elements or to keep the front and rear parts apart is a user's decision, according to his/her needs and other optional conditions.

The embodiments described above provide a guiding warhead with extended explosives safety and reliability 300, improved and simplified handling and maintenance procedures. The convenient separation of the explosive section from the guiding section enables easy testing of the operation of the explosive part without having to destroy a guiding kit during the testing. The design of the guiding warhead enables its installation inside a standard shallow or deep cavity of the projectile.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A guiding kit for guiding a projectile to a target, comprising:

a front part; and a rear part, wherein the front part and the rear part are rotatably connected to each other to enable relative rotation about a common central longitudinal axis of rotation, wherein the front part comprises a transceiver (T/X) unit disposed next to a rear end of the front part, coinciding with the longitudinal central axis of rotation and adapted to transmit signals towards the rear part, wherein a first part of an electric generator is disposed next to a front end of the rear part and comprises a generator coil, adapted to be in operational communication with a second part of the electric generator, which is disposed in the rear end of the front part and comprises magnets, wherein the rear part comprises:

an assembly container extending from the front end of the rear part backwardly, the assembly container being adapted to receive assembly operative with the projectile, by placing the assembly inside the container with a signal receiver connectable to a receiver port; and a receiver port disposed at the front end of the assembly container, against the transceiver (T/X) unit, facing the transceiver (T/X) unit and adapted to receive signals transmitted by the transceiver (T/X) unit, and wherein there is complete electrical separation between the electrical units of the front part and any unit accommodated in the rear part.

2. The guiding kit of claim 1, wherein:

the magnets of the electric generator are disposed no more than 1.5 mm from the rear end of the front part, and the coils of the electric generator are disposed no more than 1.5 mm from the front end of the rear part and distal from the common longitudinal axis by no less than half radius of the projectile, and are adapted to cooperate with the first part of the electric generator to produce electricity when the front part and the rear part rotate with respect to each other.

3. The guiding kit of claim 1, wherein the assembly container is adapted to accommodate an ignition and detonation control package, the package comprises:

an electronic unit, adapted to receive signals from the main control unit in the front part, and to control a safe-and-arm and electric detonator with safety mechanism and a detonation process;

a safe-and-arm safety unit, adapted to carry out safety measures under control of the electronic unit; and a detonation booster unit, controllable by the safe-and-arm unit.

4. The guiding kit of claim 1, wherein the assembly container is adapted to accommodate telemetry unit, the telemetry unit is adapted to receive signals from the transceiver (T/X) unit.

5. The guiding kit of claim 3 wherein electrical power to the ignition and detonation control package is provided by said generator.

6. The guiding kit of claim 3 wherein signals transferred to the ignition and detonation control package represent the status of at least one safety parameter.

7. The guiding kit of claim 1, wherein the assembly container is adapted to accommodate a metric/telemetric unit, wherein the metric/telemetric unit is adapted to receive signals from the front part representing at least one performance parameter of the guiding kit.

* * * * *